United States Patent [19]

Garbett

[11] Patent Number: 4,862,960

[45] Date of Patent: Sep. 5, 1989

[54] BLOWOUT PREVENTER TESTING APPARATUS

[75] Inventor: Keith Garbett, Castleford, England

[73] Assignee: Cameron Iron Works USA, Inc., Houston, Tex.

[21] Appl. No.: 244,787

[22] Filed: Sep. 15, 1988

[30] Foreign Application Priority Data

Jul. 12, 1988 [EP] European Pat. Off. ..... 88306339.8

[51] Int. Cl.[4] ..... E21B 23/02; E21B 33/06; E21B 34/02; E21B 47/10

[52] U.S. Cl. ..... 166/86; 73/40.5 R; 73/46; 166/250; 166/87

[58] Field of Search ..... 166/337, 336, 250, 88, 166/75.1, 387, 86, 87; 73/37, 40.5 R, 46; 285/140, 141

[56] References Cited

U.S. PATENT DOCUMENTS

| | | | |
|---|---|---|---|
| 2,540,322 | 2/1951 | Christensen | 73/37 |
| 2,660,248 | 11/1953 | Brown | 166/88 X |
| 3,093,996 | 6/1963 | Jones | 73/46 |
| 3,177,703 | 4/1965 | Waters et al. | 166/337 X |
| 3,353,596 | 11/1967 | Brown | 166/337 |
| 3,897,824 | 8/1975 | Fisher | 166/188 |
| 4,090,395 | 5/1978 | Dixon et al. | 73/40.5 R |
| 4,379,488 | 4/1983 | Hamm | 285/141 X |
| 4,554,976 | 11/1985 | Hynes et al. | 166/337 X |

*Primary Examiner*—Stephen J. Novosad

[57] ABSTRACT

An improved well structure to be installed within a wellhead housing having an internal landing seat and an internal support groove above the landing seat, a hanger having an internal bore and an external landing shoulder with the hanger positioned within the housing so that the hanger landing shoulder lands on and transmits hanger loads to the housing landing seat and a blowout preventer secured to the upper end of the housing including a closure having a body which lands within the hanger bore and including an external downwardly facing load shoulder, a split support ring positioned below the shoulder and a sleeve coacting with the split support ring so that when said closure is exposed to blowout preventer testing pressures the sleeve wedges the support ring outwardly into tight supporting engagement with said internal housing groove so that testing pressure loads are transmitted from said body loading shoulder through said support ring to said housing.

8 Claims, 4 Drawing Sheets

BLOWOUT PREVENTER TESTING APPARATUS

BACKGROUND

The present invention relates to an apparatus to be used in a well structure for testing a blowout preventer under substantial pressures wherein the pressure is exerted under the closed blowout preventer by sealing across the upper end of the hanger. With deep wells having a substantial string suspended from the hanger, the loading of the hanger landing shoulder on the housing landing seat is very substantial and the pressure loading above the hanger increases the landing seat loading well above its design point so that testing pressures will result in a failure of the landing shoulder or seat, damage to the hanger and housing and other future problems in the well.

U.S. Pat. No. 2,540,322 discloses the use of a packing seal on the drill string to allow pressure to be diverted into the casing above the packing seal for the testing of the blowout preventer.

U.S. Pat. No. 3,897,824 discloses an annular structure mounted on a string which is lowered through a blowout preventer which seals against the casing, includes passages extending axially through the structure and has a valve plate which is lowered by the string to close the passages whereby test pressure builds up above the structure to test the sealing of the blowout preventer. The testing load of the structure is transferred to the upper end of the hanger seal assembly.

U.S. Pat. No. 3,093,996 discloses another blowout preventer tester which is lowered through an open preventer and seals on the taper of the casing head to deliver pressure thereabove for the testing of the closed blowout preventer.

U.S. Pat. No. 4,090,395 discloses a structure which includes the lowering of a seal onto the upper end of the hanger for sealing across the bore of the well head and the string on which it is lowered delivers pressure to the space above the seal and below the closed blowout preventer. In this structure the pressure load, if not supported by the string is transferred directly to the hanger landing shoulder and the wellhead seat on which the hanger landing shoulder is landed.

None of these prior structures provides the capability for high pressure blowout preventer testing i. e., 15,000 psi. They do not avoid the imposition of the pressure load through the hanger landing shoulder to the housing seat.

SUMMARY

The present invention relates to an improved structure for the pressure testing of a blowout preventer to relatively high pressures to which it may be exposed in service and to the sealing structure which is positioned below the blowout preventer and includes its own support through which the pressure loading is transferred to the housing independent of the hanger loading on the housing seat. The improved closure structure of the present invention is used in combination with a wellhead housing having an internal landing seat and an internal landing groove above the landing seat, a casing hanger landed within the housing with its external landing shoulder on the internal landing seat of the housing, a blowout preventer secured in position above the hanger to close the housing from above and the closure structure includes a tubular body with a bore therethrough and valving means for closing such bore and being a suitable size to be lowered through the blowout preventer and into the housing above the casing hanger for landing on the upper portion of the casing hanger, said closure structure having landing means for engaging within the internal housing groove and a sliding sleeve on the exterior of the tubular body adapted to slide within said landing means for forcing it outward into engagement within said internal housing groove, a downwardly facing shoulder on the upper portion of said body positioned to engage said landing means when it is engaged within said internal housing groove to transfer the pressure loading to the housing internal groove, which loading force results from the testing pressure above such closure structure within the housing during the testing of the blowout preventer. It is preferred that the sleeve be landed on the upper end of the casing hanger and that the tubular body move downwardly therein responsive to testing pressure to set said landing means and transfer the loading force of the pressure through the landing means to the housing rather than through the hanger to the housing.

An object of the present invention is to provide an improved blowout preventer testing structure in which the downward loading force resulting from the blowout preventer testing pressure is not transferred through the casing hanger to the housing internal landing seat.

Another object is to provide an improved closure member for the testing of a blowout preventer on a wellhead housing which closure member is responsive to the testing pressure and transfers the pressure load directly to the housing.

Still another object is to provide an improved closure structure which can be used within a wellhead housing following emergency completion to test the blowout preventer without overloading the housing landing seat and the hanger landing shoulder.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENTS

Figure 1A:
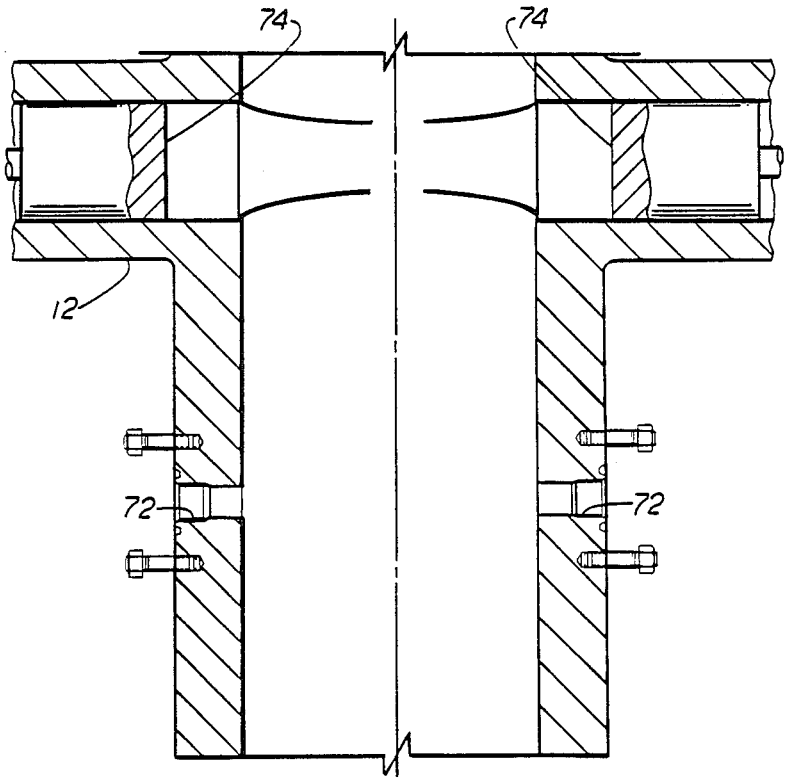
FIG. 1 is an elevation partially in section which illustrates the improved wellhead structure with the casing hanger and closure structure being shown in the lower portion of the well housing (FIG. 1B) and with the blowout preventer being shown connected to the upper portion of the housing (FIG. 1A).

Wellhead housing 10 is positioned within a well bore and has blowout preventer 12 connected on its upper end. Internal housing landing seat 14 is provided in the lower portion of housing 10 as shown and casing hanger 16 which has external landing shoulder 18 is landed within housing 10 with shoulder 18 in engagement with seat 14. Groove 20 is positioned within the lower portion of the interior wall of blowout preventer 12. The usual seal and lockdown assembly 22 is positioned in the annular space 24 between the exterior of the upper rim 26 of casing hanger 16 and the interior of wellhead housing 10 above landing seat 14. Assembly 22 provides the seal across the annular space 24 and wedges split ring 28 into latching engagement within groove 30 on the interior of housing 10 a short distance above landing seat 14.

Closure member 32 is lowered through blowout preventer 12 into wellhead housing 10 and has its lower end positioned within the upper interior of casing hanger rim 26 as shown in FIG. 1. Closure member 32 includes tubular body 34 having internal threaded seat 36 in which back pressure valve 38 is positioned. The lower exterior of tubular body 34 includes external seals 40 for sealing against the interior of hanger rim 26 and keys 42 which are secured in axial orientation on the exterior of body 34 above seals 40. Exterior surface 44 above keys 42 extends upwardly to downwardly facing shoulder 46. Surface 48 ends in upper downwardly facing shoulder 50. Surface 51 above shoulder 50 has a diameter which is smaller than the interior diameter of the lower portion of blowout preventer 12 above and below groove 20. Landing means (split support ring 52) is positioned around body 34 in surrounding relationship to surface 48 and in engagement with shoulder 50. Sleeve 54 is positioned around the exterior of body 34 and includes an upper wedge-shaped end 56 which coacts with tapered surface 58 on the lower inner surface of split support ring 52 so that movement of sleeve 54 upward under ring 52 causes split support ring 52 to be wedged outwardly into internal housing groove 20, as shown in FIG. 2. Sleeve 54 includes internal upwardly facing shoulder 60 and lower rim 62 which includes slots 64 to receive keys 42. On landing of closure member 32, the lower end of rim 62 of sleeve is in engagement with the upper end of hanger rim 26. Spring 66 is positioned on the interior of sleeve 54 and around the exterior of body 34 below shoulder 46 and around surface 44 above shoulder 60. The spring force is exerted against sleeve shoulder 60 to urge sleeve 54 downwardly with respect to body 34.

Communications to the interior of housing 10 are provided by lower ports 68, intermediate ports 70 and upper ports 72 through the lower portion of blowout preventer housing. Ports 72 would be used to provide a supply of fluid under pressure for the testing of the effective sealing of the rams 74 of blowout preventer 12 as hereinafter explained.

Figure 1B:
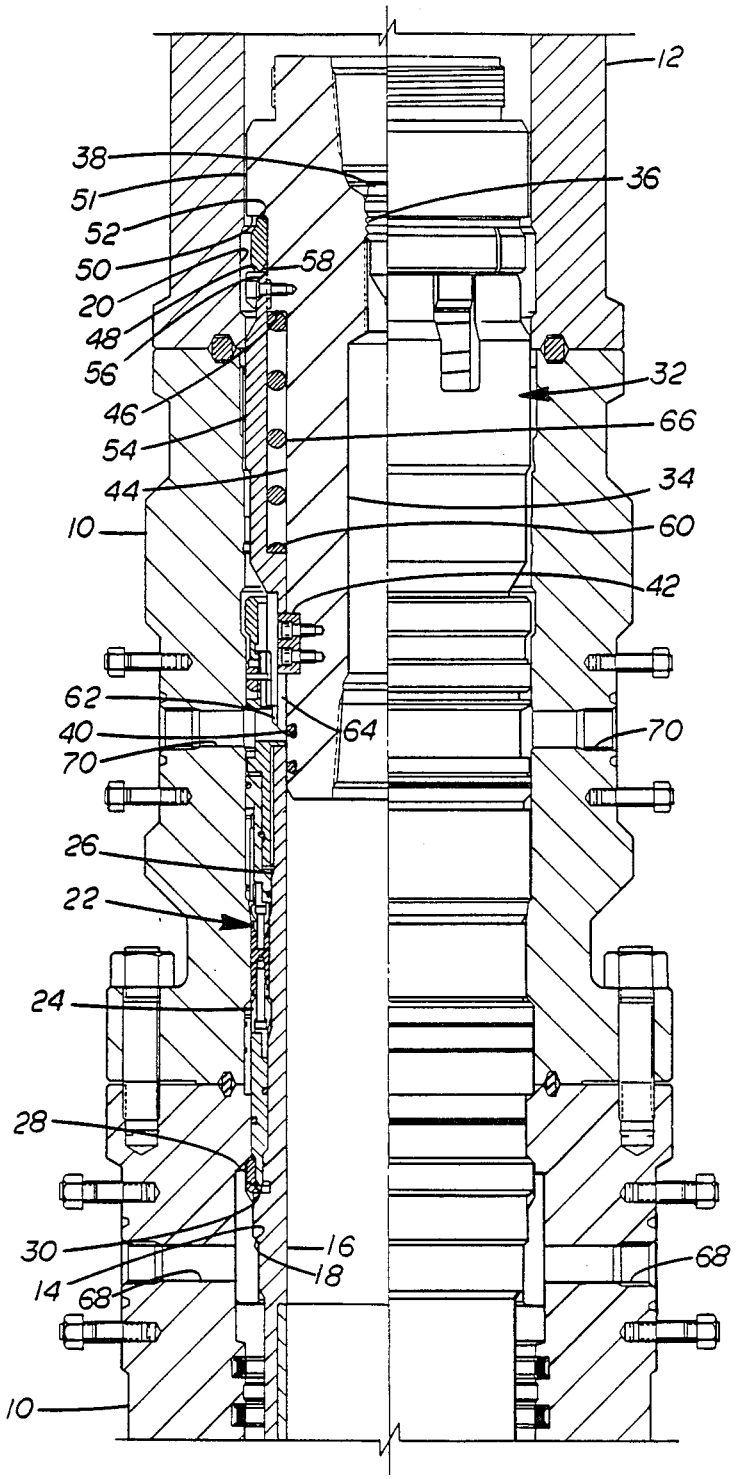
Figure 2:
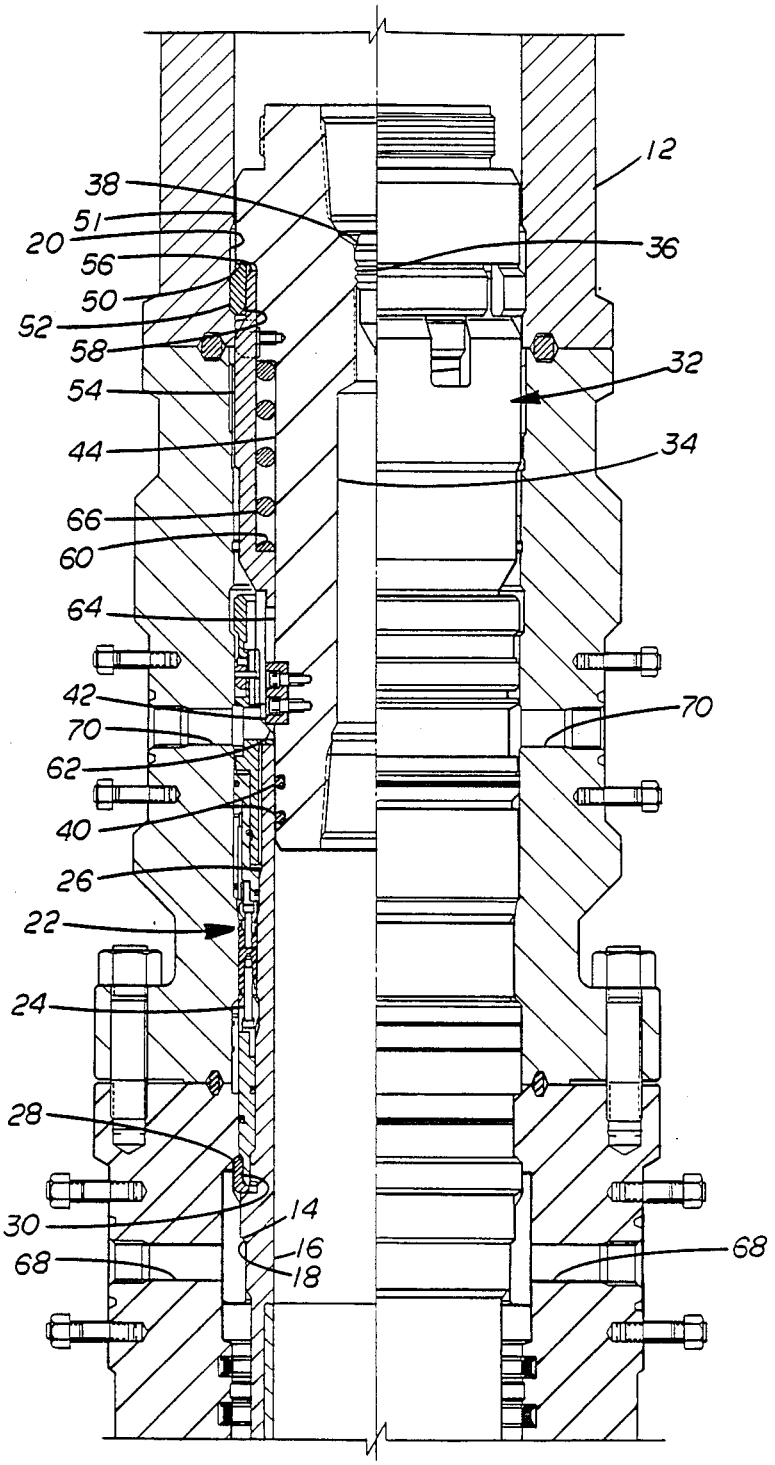
FIG. 2 is another view similar to FIG. 1B which illustrates the improved wellhead structure and the position of the closure structure during the pressure testing of the blowout preventer.

In operation, closure member 32 is lowered through blowout preventer 12 and into housing 10 to the position as shown in FIG. 1B. Testing of blowout preventer 12 proceeds with the closing of its rams 74 to their position sealing across the bore 76 through blowout preventer 12. Thereafter fluid pressure is supplied through one of the ports 72 and allowed to build up to the testing pressure. As this pressure increases it is exerted on closure member 32 causing it to move downwardly to the position shown in FIG. 2. The movement of closure member body 34 is downwardly within the interior of hanger upper rim 26 but sleeve 54 is restrained from downward movement by its engagement with the upper end of rim 26. This causes split support ring 52 to move downwardly on the upper end of sleeve 54 and ring 52 is wedged outwardly into tight engagement between the lower shoulder of groove 20 and downwardly facing shoulder 50 on closure body 34 so that all of the pressure load thereafter resulting from the test pressure above closure member 32 is transferred through shoulder 50 to ring 52 and to lower shoulder of groove 20 in blowout preventer 12 into housing 10. The only additional load which is transmitted to hanger 16 is that spring loading resulting from the relative movement of sleeve 54 with respect to body 34.

With this configuration the high pressures which are required for adequate pressure testing of the blowout preventer on deeper and more recent wells can be accomplished without over-loading the landing seat on the well housing and the casing hanger landing shoulder.

Figure 3:
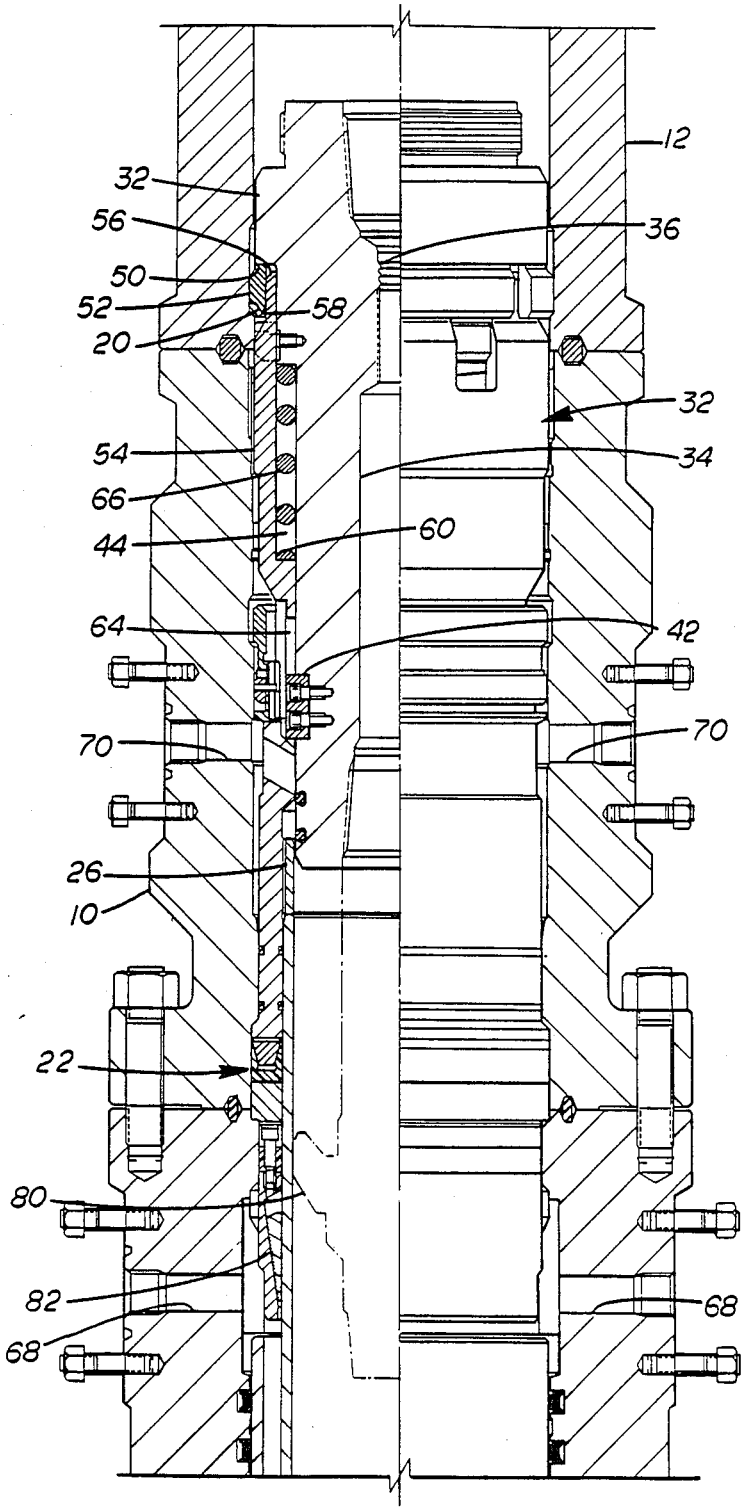
FIG. 3 is another similar view showing a modified structure which can be used in emergency completions and is shown in its testing position.

A modified form of the present invention is illustrated in FIG. 3 wherein similar parts are given the same number designation. Thus, closure member 32 is landed with its lower end within upper rim 26 of hanger 16 and has a cup tester 80 threaded into the lower internal threads in tubular body 34 to complete the closure of the bore within hanger 16 below the blowout preventer 12. This would be used in emergency completions with transfer of the load through the seal assembly 22 to housing 10.

With the apparatus positioned as shown in FIG. 3, the closing of the blowout preventer rams 74 and application of fluid pressure above closure member 32 will cause the completion of the setting of closure member 32 with the pressure load being transferred by shoulder 50 to split support ring 52 onto the lower shoulder of groove 20. In this manner all of the pressure loading is transferred to housing 10 and does not pass through hanger 16 to landing seat 14 on the interior of housing 10.

What is claimed is:

1. A wellhead structure for pressure testing a blowout preventer secured to the upper portion of a wellhead housing which has an internal landing seat and an internal load supporting groove above the landing seat comprising a hanger having an external landing shoulder landed within the housing on the internal housing landing seat and having a hanger body with a bore extending therethrough and an upper rim extending above the landing shoulder, seal means for sealing between the exterior of the hanger rim and the interior of the housing, a closure member having a tubular body, means for closing the flow through the interior of the tubular closure member body, including a back pressure valve secured within the bore through said closure member body and preventing flow downwardly through said closure member body bore, a downwardly facing exterior load shoulder on said closure member body, a split support ring surrounding said closure member body immediately below said closure member body load shoulder, a sleeve surrounding said closure member body and having a surface to coact with said split support ring so that relative movement of said sleeve within said split support ring wedges said split support ring into supporting engagement for said closure member body with said internal housing groove, and said movement of said sleeve within said split support ring being responsive to testing pressure between said blowout preventer and said closure member.

2. A wellhead structure for pressure testing a blowout preventer secured to the upper portion of a wellhead housing which has an internal landing seat and an internal load supporting groove above the landing seat comprising a hanger having an external landing shoulder landed within the housing on the internal housing landing seat and having a hanger body with a bore extending therethrough and an upper rim extending above the landing shoulder, shoulder, seal means for sealing between the exterior of the hanger rim and the interior of the housing, a closure member having a tubular body, means for closing the flow through the interior of the tubular closure member body, including a cup tester secured within the lower portion of said bore, a downwardly facing exterior load shoulder on said closure member body, a split support ring surrounding said closure member body immediately below said closure member body load shoulder, a sleeve surrounding said closure member body and having a surface to coact with said split support ring so that relative movement of said sleeve within said split support ring wedges said split support ring into supporting engagement for said closure member body with said internal housing groove, and said movement of said sleeve within said split support ring being responsive to testing pressure between said blowout preventer and said closure member.

3. A wellhead structure for pressure testing a blowout preventer secured to the upper portion of a wellhead housing which has an internal landing seat and an internal load supporting groove above the landing seat comprising a hanger having an external landing shoulder landed within the housing on the internal housing landing seat and having a hanger body with a bore extending therethrough and an upper rim extending above the landing shoulder, seal means for sealing between the exterior of the hanger rim and the interior of the housing, a closure member having a tubular body, means for closing the flow through the interior of the tubular closure member body, a downwardly facing exterior load shoulder on said closure member body, a split support ring surrounding said closure member body immediately below said closure member body load shoulder, a sleeve surrounding said closure member body and having a surface to coact with said split support ring so that relative movement of said sleeve within said split support ring wedges said split support ring into supporting engagement for said closure member body with said internal housing groove, said sleeve engages the upper end of said hanger rim and said closure member body moves downwardly within said hanger bore with said sleeve held against downward movement by its engagement with said rim whereby said split support ring is moved downwardly on said sleeve to be wedged outward into engagement within said internal housing groove, said movement of said sleeve within said split support ring being responsive to testing pressure between said, blowout preventer and said closure member.

4. A wellhead structure for a well comprising a wellhead housing positioned within a well and having an internal landing seat and an internal landing support groove above said landing seat, a hanger having a tubular body with a bore, an external landing shoulder engaged on and transmitting hanger loads to said housing landing seat, and an upper rim above said hanger landing shoulder, a blowout preventer secured to the upper end of said housing, a closure member having a bore therethrough, a body with an external downwardly facing shoulder, a support means positioned around said closure member body below said downwardly facing closure shoulder and means responsive to testing pressure between said closure member and said blowout preventer for wedging said support means into load transmitting position between said closure member downwardly facing shoulder and said internal housing groove so that pressure loads responsive to pressure testing of said blowout preventer are transmitted to said housing groove by said closure member shoulder and said support means, and a back pressure valve mounted within said bore to prevent backward flow therethrough during pressure testing of said blowout preventer.

5. A wellhead structure according to claim 4 wherein said support means is a split support ring surrounding said closure member body under said downwardly facing shoulder.

6. A wellhead structure according to claim 5 wherein said pressure responsive means is a sleeve surrounding said closure body and restrained against downward movement when said closure body moves downwardly with respect to said hanger responsive to testing pressure.

7. A wellhead structure according to claim 6 wherein said sleeve coacts with said support ring responsive to downward movement of said closure body and said support ring to wedge said support ring into tight load transmitting engagement with said internal housing groove.

8. A wellhead structure for a well comprising a wellhead positioned within a well and having an internal landing seat and an internal landing support groove above said landing seat, a hanger having a tubular body with a bore, an external landing shoulder engaged on and transmitting hanger loads to said housing landing seat, and an upper rim above said hanger landing shoulder, a blowout preventer secured to the upper end of said housing, a closure member having a bore therethrough, a body with an external downwardly facing shoulder, a support means positioned around said closure member body below said downwardly facing closure shoulder and means responsive to testing pressure between said closure member and said blowout preventer for wedging said support means into load transmitting position between said closure member downwardly facing shoulder and said internal housing groove so that pressure loads responsive to pressure testing of said blowout preventer are transmitted to said housing groove by said closure member shoulder and said support means, and a cup tester secured to said closure member body to prevent downwardly flow therethrough during pressure testing of said blowout preventer.

* * * * *